US005633482A

United States Patent [19]

Erion et al.

[11] Patent Number: 5,633,482

[45] Date of Patent: May 27, 1997

[54] MOTORCYCLE EXHAUST SYSTEM

[75] Inventors: Craig Erion, Santa Ana; Christopher Samhammer, Newport Beach, both of Calif.

[73] Assignee: Two Brothers Racing, Inc., Santa Ana, Calif.

[21] Appl. No.: 540,467

[22] Filed: Oct. 10, 1995

[51] Int. Cl.[6] ..... F01N 7/18

[52] U.S. Cl. ..... 181/282; 181/228; 181/249; 181/252

[58] Field of Search ..... 181/227, 228, 181/243, 249, 252, 255, 256, 264, 282

[56] References Cited

U.S. PATENT DOCUMENTS 4,239,091 12/1980 Negrao ..... 181/243
4,368,799 1/1983 Wagner ..... 181/255
4,834,214 5/1989 Feuling ..... 181/282 X
4,993,513 2/1991 Inoue et al. ..... 181/282

*Primary Examiner*—Khanh Dang
*Attorney, Agent, or Firm*—Plante & Strauss

[57] ABSTRACT

The invention comprises an exhaust system for a motorcycle engine which has an outer imperforate casing having a substantially elliptical cross-section and an inner, coaxial, perforate sleeve also of elliptical cross-section which is of lesser dimensions to provide an annulus within the casing which is packed with a gas permeable material, high temperature resistant material such as fiberglass. The muffler has a single piece inlet end cap and a single piece outlet end cap. Each end cap has an elliptical flange over which is received an end of the outer casing of the muffler. The end caps also have integral mounting flanges to receive and support the inner perforate sleeve. Preferably the muffler is provided with a replaceable sound choke which is a small diameter sleeve that can be removably secured in the discharge end of the muffler, thereby permitting the muffler to be switched between restricted off-road use and unrestricted off-road use.

8 Claims, 3 Drawing Sheets

MOTORCYCLE EXHAUST SYSTEM

BACKGROUND OF THE INVENTION

1. Field of the Invention

This invention relates to an exhaust system and, in particular, to an exhaust system for motorcycles for performance applications such as off road racing.

2. Brief Statement of the Prior Art

Standard motorcycle exhaust systems include sound reducing mufflers which usually have a casing with internal baffles to provide a tortuous pathway for the exhaust gases to reduce the decibels and staccato racket of the engine. While the original equipment manufacturer's exhaust systems provide very significant reduction in sound intensity, that sound reduction is accompanied by a reduction in performance because of the back pressure the exhaust system places on the motorcycle engine.

When motorcycles are used in off-road applications such as racing and sport riding, it is fairly common to replace the original equipment mufflers with exhaust systems that have a greatly reduced back pressure, thereby achieving maximum performance from the engine. Additionally, it is desirable to enhance the sound of the engine from a staccato noise to a more even, resonant sound.

Glass pack mufflers have been used in various automotive applications such as hot rods. The conventional automotive glass pack muffler is a cylindrical canister which surrounds a portion of the exhaust pipe with the annulus between the exhaust pipe and the canister packed with fiber glass.

OBJECTIVES OF THE INVENTION

It is an objective of this invention to provide a motorcycle exhaust system for off-road use.

It is an additional objective of this invention to provide a motorcycle exhaust system which achieves some noise-reduction without imposing any significant back pressure on the engine.

It is a further objective of this invention to provide a muffler exhaust system which can be readily retrofitted to a motorcycle using existing brackets and hardware.

It is likewise an objective of this invention to provide a muffler for an exhaust system for a motorcycle which is of limited protrusiveness.

It is yet another objective of this invention to provide a muffler for a motorcycle which is suitable for off-road applications and which includes a optional sound choke component that can be added to or removed from the muffler to adopt to off-road and street use.

Other and related objectives will be apparent from the following description of the invention.

BRIEF STATEMENT OF THE INVENTION

The invention comprises an exhaust system for a motorcycle engine which has an outer imperforate casing having a substantially elliptical cross-section and an inner, coaxial, perforate sleeve also of elliptical cross-section which is of lesser dimensions to provide an annulus within the casing which is packed with a gas-permeable, high-temperature-resistant material, such as fiberglass. The muffler has a single piece inlet end cap and a single piece outlet end cap. Each end cap has an elliptical flange over which is received an end of the outer casing of the muffler. The end caps also have integral mounts to receive and support the inner perforate sleeve. Preferably the muffler is provided with a replaceable sound choke which is a small diameter sleeve that can be removably secured in the discharge end of the muffler, thereby permitting the muffler to be adopted to either street or off-road use.

BRIEF DESCRIPTION OF THE DRAWINGS

The invention will be described with reference to the figures of which.

DESCRIPTION OF PREFERRED EMBODIMENT

Figure 1:
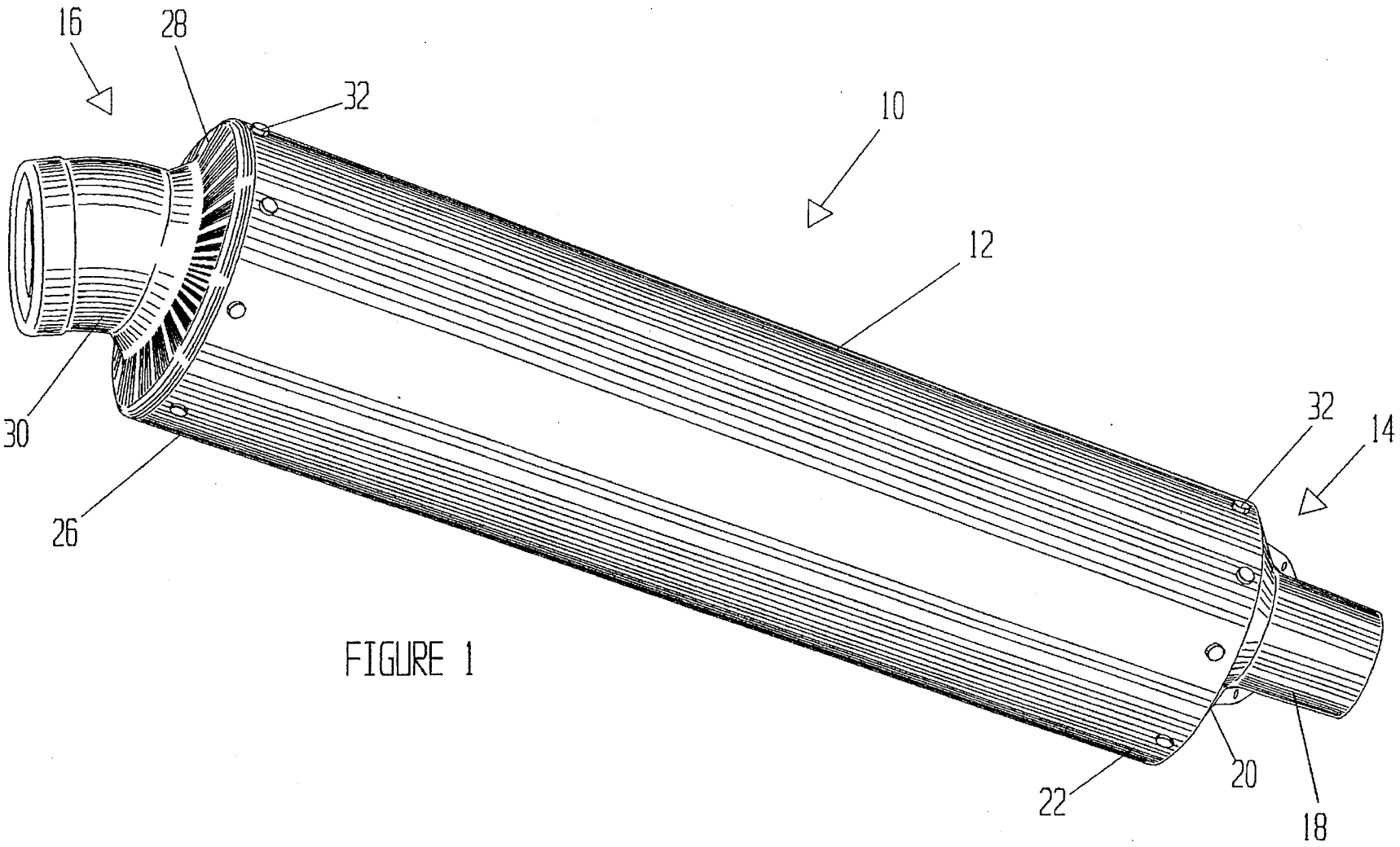
FIG. 1 is a perspective view of the muffler of the invention.

Referring to FIG. 1, the muffler 10 of the invention, which is suitable for motorcycle applications, comprises an outer imperforate casing 12 which extends between opposite end caps 14 and 16. The inlet end cap 14 has a cylindrical neck 18 which is integral with an elliptical flange 20 that receives the inlet end 22 of the outer casing 12 which is secured thereto by conventional fasteners such as permanent rivets 32. The outlet end 26 of the muffler 10 has an outlet end cap 16 which has a neck 30 of generally elliptical cross-section, and that is slightly arcuate to deflect the exhaust gases from the centerline of the muffler, consistent with the mounting of the muffler in most motorcycle applications.

The outlet end cap 16 also has an integral elliptical flange 28 dependent from the outlet neck 30 and this flange receives the outlet end 26 of the outer casing 12 which is secured thereto by suitable fasteners; permanent rivets 32 being illustrated in FIGS. 1–6.

Referring now to FIGS. 2–6, the muffler of the invention is shown in sectional view. As there illustrated, the inlet end cap 14 and outlet end cap 16 are single-piece, monolithic castings. As previously mentioned, the inlet end cap 14 has a cylindrical neck 18 terminating in an elliptical flange 20 which has an elliptical rim 34 that provides a seat on which is received the inlet end 22 of the outer casing 12.

Figure 2:
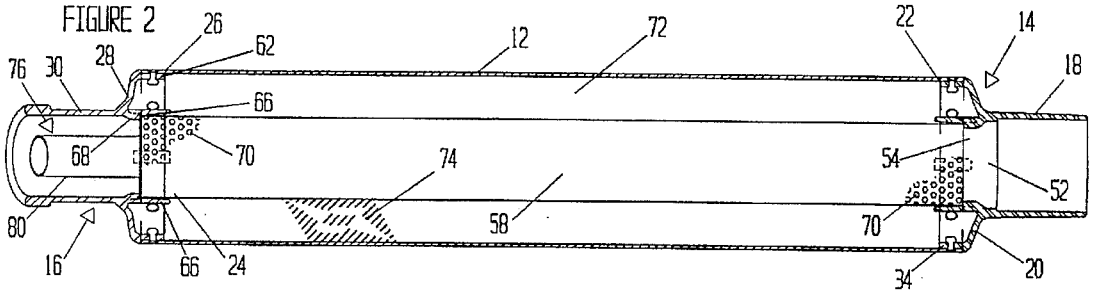
FIGS. 2 and 3 are sectional views of the muffler of the invention.
Figure 3:
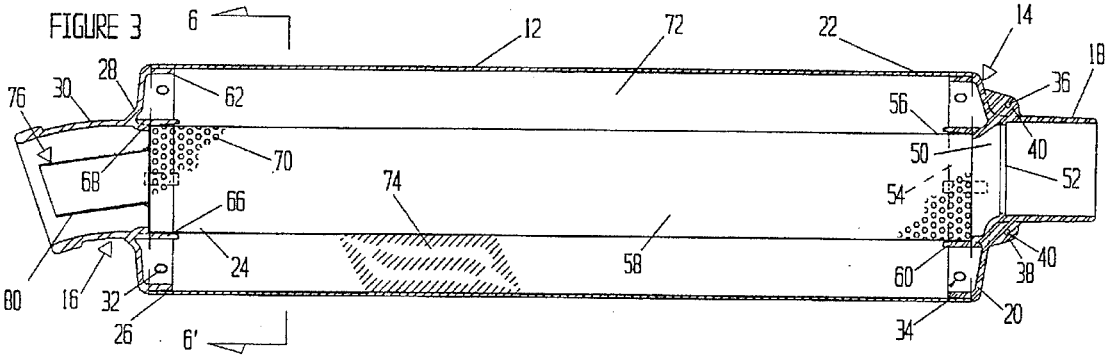
Figure 5:
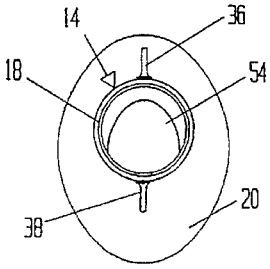
FIG. 5 is a view of the inlet end of the muffler of the invention.

As shown in FIGS. 3 and 5, the neck 18 of the inlet end cap 14 is offset from the axis of the muffler, consistent with the particular motorcycle application to permit use of the manufacturer's brackets and mounting hardware for the muffler. The end cap 14 also has a pair of ears 36 and 38, integral with the cap 14 which have an aperture 40 for receiving mounting bolts, consistent with the particular application of the muffler. The flange 20 of the inlet end cap 14 has a transition section 50 with a cylindrical inlet 52 and an elliptical outlet 54 communicating with the inlet end 56 of the inner, perforate sleeve 58 that is co-axial with the outer casing 12 of the muffler 10. The sleeve 58 has a plurality of through apertures 70 evenly spaced across its entire surface, portions of which are shown in the illustrations. The flange 20 of the inlet end cap also has a plurality of axially extending prongs 60 disposed circumferentially about the outlet 54 of the transition section 50 which serve to receive and retain the inlet end 56 of the inner perforate sleeve 58 of the muffler. At its outlet end 26, the muffler has an outlet end cap 16 which has a neck 30 with an elliptical cross-section. The neck 30 is slightly arcuate to deflect the exhaust gases from the centerline of the muffler, in a manner in accordance with the conventional mufflers of the particular installation. The outlet neck of the outlet end cap also has an elliptical flange 28 having an elliptical lip 62 over which is received the outlet end 26 of the outer imperforate casing 12 of the muffler. The outer casing is permanently affixed to the outlet end cap with fasteners such as rivets 32. The outlet end cap 16 also has a plurality of axially extending prongs 66 that are circumferentially disposed about the inner end 68 of the neck 30 of the outlet end cap to receive and support the outlet end 24 of the inner perforate sleeve 58 of the muffler. As apparent from FIGS. 2 and 3, the inner sleeve 58 and outer casing 12 of the muffler are generally elliptical in cross section and have substantially identical elliptical shapes, thereby providing an elliptical annulus 72 in which is disposed suitable high temperature resistant, gas-permeable packing such as fiberglass 74. The elliptical cross-section of the casings 12 has a ratio of minor to major axes from 0.7 to 0.85.

Figure 4:
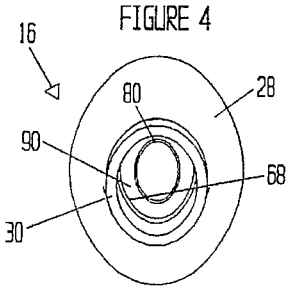
FIG. 4 is a view of the outlet end of the muffler of the invention.
Figure 6:
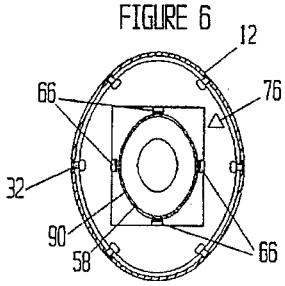
FIG. 6 is a sectional view along line 6–6' of FIG. 3.

In the preferred embodiment, the muffler is adaptable to off-road or street use, and for this purpose has a replaceable sound choke 76, which is disposed within the outlet end cap 16. As shown in FIGS. 2–4, the sound choke 76 comprises a sleeve 80 which is dependent from a flat flange 90 (see also FIG. 6), which is captured within the assembly of the end cap 16 and inner sleeve 58 thereby supporting the sleeve 80 within the outlet sleeve 30 of end cap 16.

Figure 7:
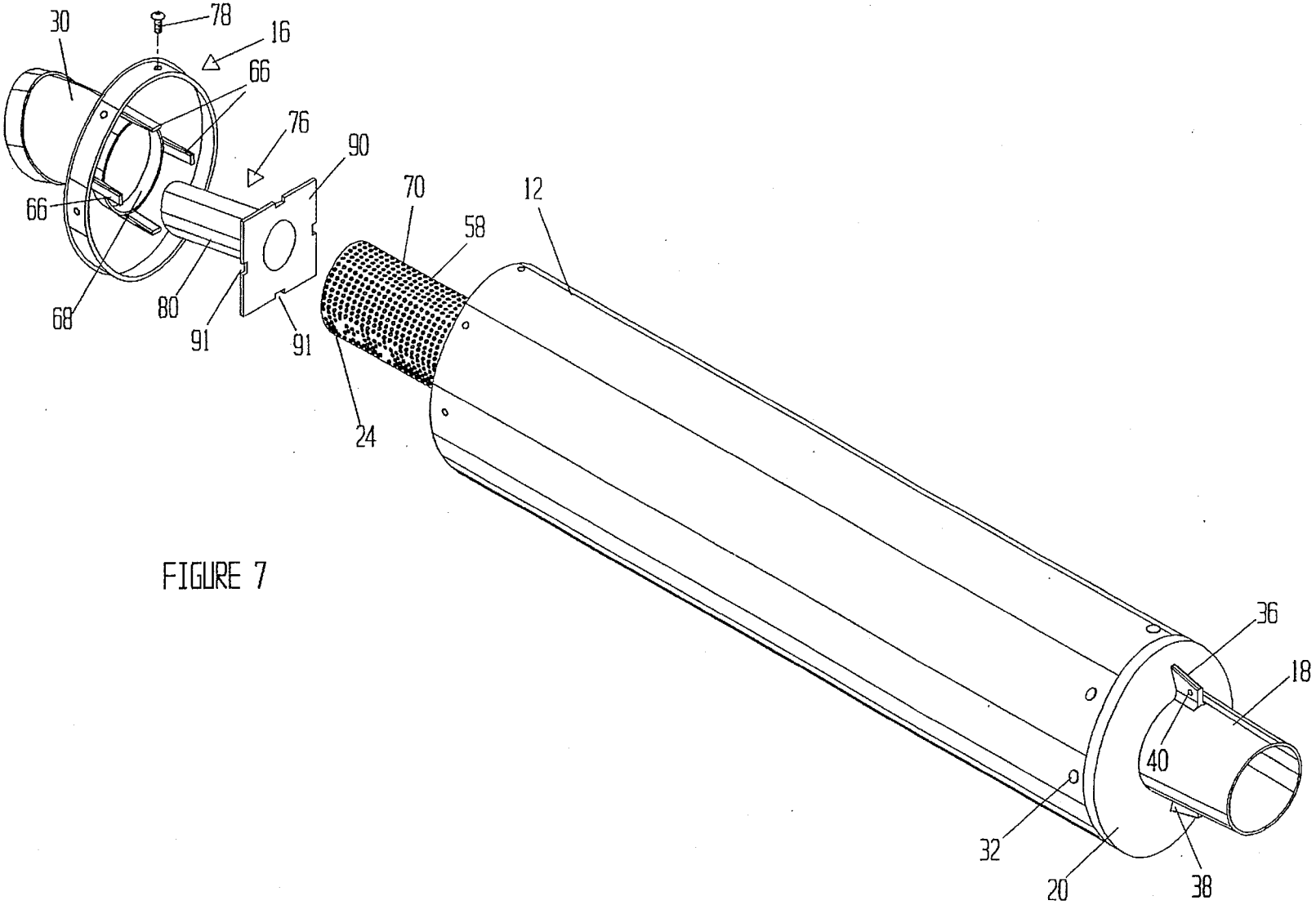
FIG. 7 is an exploded perspective view of the muffler of the invention illustrating the installation of the optional sound choke.

Referring now to FIG. 7, the outlet end of the muffler is shown in exploded view. In the preferred embodiment, the outer muffler casing 12 is secured to the outlet end cap 16 with removable fasteners such as machine screws 78 that can be removed to permit removal of the outlet end cap 16. The inner end 68 of the neck 30 of the outlet end cap 16 has a plurality of axially extending prongs 60 which are received about the outlet end 24 of the inner sleeve 58.

The sound choke 76 is captured between the inner end 68 of the neck 30 of the outlet end cap 16 and the outlet end 24 of the inner perforate sleeve 58. The flange 90 has a plurality of slots 91 which provide clearances for the prongs 66 of the end cap 16, thereby permitting the flange 90 of the choke 76 to be inserted against the inner end 68 of the neck 30 of the end cap 16. In this position, the choke 76 is captured in the assembly by the outlet end 24 of the inner sleeve 58 which bears against the flange 91 of the sound choke 76.

In this construction, the sound choke 76 is readily removable by loosening the assembly screws 78, removing the end cap 16 and extracting the sound choke 76 from the end cap 16 and replacing the end cap 16 in the assembly. In a similar fashion, the sound choke 76 can be installed to adopt the muffler for street application in a simple operation which can be quickly accomplished.

The invention provides for economy in manufacture, as the muffler is an assembly of only four components and the fiberglass packing. The components can be easily assembled, as the inner sleeve and outer casing are easily aligned by mounting to the end caps since the inner prongs of the end caps center and retain the inner sleeve.

The elliptical cross section of the muffler provides for minimum obtrusiveness. Additionally, it has been observed that the muffler of the invention with its elliptical shape for the outer casing and inner sleeve achieves a significant reduction in noise over similar glass-packed mufflers with cylindrical shapes.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. An exhaust system for a motorcycle engine which comprises:

a. an outer tubular imperforate casing having a substantially elliptical cross section throughout its length with a ratio of minor to major axes from 0.70 to 0.85;

b. an inner tubular, perforate sleeve also having a substantially elliptical cross section throughout its length with substantially the same ratio of minor to major axes and concentrically received within said outer casing to form an elliptical annulus therebetween;

c. gas permeable, high temperature resistance inert packing disposed within said elliptical annulus;

d. single-piece inlet and outlet end caps, each having a sleeve with an integral elliptical flange having a dependent ellipsoidal skirt with the opposite ends of said outer casing received over and secured to said skirts, and with each of said end caps having inner support members with the opposite ends of said inner perforate sleeve received against said inner support members, thereby positioning said inner perforate sleeve in concentric alignment to said outer casing.

2. The exhaust system of claim 1 wherein said support members comprise a plurality of axial prongs spaced about the inner peripheries of said sleeves.

3. The exhaust system of claim 2 wherein said inner perforate sleeve is received within said axial prongs.

4. The exhaust system of claim 1 wherein the sleeve of said inlet end cap is cylindrical throughout most of its length.

5. The exhaust system of claim 2 wherein said the sleeve of said inlet end cap has an elliptical outlet port contiguous to said inner perforate sleeve.

6. The exhaust system of claim 1 including a sound choke removably received and contained within the sleeve of said outlet end cap.

7. The exhaust system of claim 6 wherein said sound choke comprises a sleeve of lesser diameter than said sleeve of said outlet end cap and including a radial flange which is captured within said casing by said outlet end cap.

8. The exhaust system of claim 1 wherein said outlet end cap is removably attached to said outer casing, to permit its disassembly for removal or installation of said sound choke.

* * * * *